US005879019A

United States Patent [19]

Mantel

[11] Patent Number: 5,879,019

[45] Date of Patent: Mar. 9, 1999

[54] PISTE SKI EQUIPPED WITH A DEVICE INTENDED TO ADAPT THE TRANSVERSE POSITION OF A BINDING AS A FUNCTION OF FORCES EXERTED BY THE SKIER

[75] Inventor: Denis Mantel, Brignoud, France

[73] Assignee: Skis Rossignol S.A., France

[21] Appl. No.: 754,132

[22] Filed: Nov. 22, 1996

[30] Foreign Application Priority Data

Nov. 29, 1995 [FR] France ..... 95 14377

[51] Int. Cl.[6] ..... A63C 9/00

[52] U.S. Cl. ..... 280/620; 280/633; 280/636

[58] Field of Search ..... 280/602, 607, 280/618, 620, 633, 636, 617

[56] References Cited

U.S. PATENT DOCUMENTS

| | | | |
|---|---|---|---|
| 4,139,214 | 2/1979 | Meyer | 280/617 |
| 4,804,200 | 2/1989 | Kuchler | 280/602 |
| 5,011,179 | 4/1991 | Bejean et al. | 280/615 |
| 5,054,807 | 10/1991 | Fauvet | 280/607 |
| 5,499,836 | 3/1996 | Juhasz | 280/602 |
| 5,647,605 | 7/1997 | Arduin | 280/602 |
| 5,671,939 | 9/1997 | Pineau | 280/602 |

FOREIGN PATENT DOCUMENTS

| | | | |
|---|---|---|---|
| WO 91/11232 | 8/1991 | France | 280/618 |
| 3540428 | 11/1986 | Germany . | |
| 3832290 | 5/1990 | Germany . | |

*Primary Examiner*—J. J. Swann
*Assistant Examiner*—Bridget Avery
*Attorney, Agent, or Firm*—Parkhurst & Wendel, L.I

[57] ABSTRACT

A ski including a lower gliding face, bordered by ridges respectively constituting an outer edge (5) and an inner edge (4), the inner edge corresponding to the two opposite edges of two skis of a pair of skis for accommodating an intermediate device consisting of at least one platform (10, 30, 45, 60, 70, 85, 90, 91, 100) on which a safety binding, composed of a toe piece and a heel piece, is mounted, the longitudinal mid-plane (25, 66, 81, 108) of the platform being coincident with the longitudinal mid-plane (6) of the gliding board, when the device supports the skier's weight. The intermediate device includes means for shifting the position of the longitudinal mid-plane (25, 66, 81, 108) of the platform, relative to the longitudinal mid-plane (6) of the ski board and at least one return member (12, 22) for returning the two longitudinal mid-planes respectively of the platform and of the gliding board, back to the coincident position. The shifting means act, under the effect of a force directed perpendicularly to the upper face of the gliding board, by causing a lateral shift of the longitudinal mid-plane of the platform, the lateral shift being an increasing function of the force.

28 Claims, 8 Drawing Sheets

Ar 62
56
64
4
65
61
60
55
5
6
Av
Ar

Do
D
66
6
Av

PISTE SKI EQUIPPED WITH A DEVICE INTENDED TO ADAPT THE TRANSVERSE POSITION OF A BINDING AS A FUNCTION OF FORCES EXERTED BY THE SKIER

TECHNICAL FIELD

The invention concerns the field of piste or down skiing, and yet more precisely relates to a ski which has a device making it possible to shift the position of the skier's foot relative to the longitudinal mid-axis of the ski as a function of the magnitude of the forces generated by the skier when setting the edges.

PRIOR ART

As is known, during the impulse required to initiate a turn when engaging in piste skiing, the skier exerts a force directed toward the surface of the sole. As a function of the duration and, above all, the magnitude of these forces, long turns are sometimes obtained, characteristic of engaging in giant slalom, or short turns are sometimes obtained, observed when engaging in slalom, the latter requiring bearing forces which are greater but of shorter duration. Typically, measurements have shown that these vertical forces may reach 500 daN for an 80 kg skier, that is to say that these forces may exceed six times the skier's weight.

It has been proposed to adapt the skis to the various techniques for which they are intended, by designing structures and also dimension lines particular to each of these versions. It will be recalled that the dimension line of a ski is, according to a standardized definition, the line representing the lateral contour of the gliding surface of the ski in the region located between the front maximum width point and the rear maximum width point. This line is defined by the lower ridges. Thus, the dimension line of a ski intended for slalom is generally more concave than the dimension line of a ski for giant slalom. As an approximation, it may be considered that a concave dimension line brings the lower edge closer to the longitudinal mid-axis of the ski, which reduces the torque and time necessary to change from one edge to the other and therefore increases the maneuvering speed.

Patent FR-A-2, 660, 567, corresponding to patent U.S. Pat. No. 5,286,051, has already proposed to shift the position of the foot transversely relative to the ski by installing the bindings off-axis relative to the longitudinal mid-axis of the ski. Unfortunately, this off-axis installation is not ideal under all conditions in which a ski is used.

In addition, document DE 38 32 290 has proposed to equip a cross-country ski with a device making it possible to displace the binding when using the skating step. More precisely, this device consists of a platform which can be displaced transversely on the upper face of the ski and is connected to the latter by means of compression springs. Thus, during the propulsion phases when the skier exerts a lateral and transverse force parallel to the upper face of the ski, the platform is displaced while compressing the aforementioned springs. The apparent hardness of the ski is therefore modified, which improves the skier's comfort. This solution can under no circumstances be adapted to the field of piste skiing. This is because, when mounted on an alpine ski, a device of this type would cause the foot to float relative to the board, which would result in risks of crossing the skis and falling.

The problem which the invention is intended to solve is to allow the transverse position of the binding to be adapted dynamically as a function of the magnitude of the forces applied to the ski by the skier.

DESCRIPTION OF THE INVENTION

The invention relates to a piste ski having:

a lower gliding face, bordered by ridges, respectively constituting an outer edge and an inner edge, said inner edge corresponding to the two opposite edges when the two skis of a pair are laid flat beside one another;

an upper face intended, in the support region, to accommodate an intermediate device consisting of at least one platform on which a safety binding, composed of a toe piece and a heel piece, is mounted, the longitudinal mid-plane of the platform being coincident with the longitudinal mid-plane of the gliding board, when the device supports the skier's weight, said intermediate device including:

means which can, under the effect of a force, shift the position of the longitudinal mid-plane of the platform, relative to the longitudinal mid-plane of the ski board;

and at least one return member intended, in the absence of said force, to return the two longitudinal mid-planes respectively of the platform and of the gliding board, into the coincident position;

This ski is one wherein said shifting means act, under the effect of a force directed perpendicularly to the upper face of the gliding board, by causing a lateral shift of the longitudinal mid-plane of the platform, said lateral shift being an increasing function of said force.

In other words, by virtue of the device according to the invention, the binding installed on the characteristic platform has a capacity for displacement relative to the ski. The intermediate device is arranged in such a way that, when the skier exerts a vertical force, this causes a modification in the position of the platform relative to the upper face of the ski. This displacement is an increasing function of the magnitude of the force exerted by the skier, that is to say the shift increases as the force applied by the skier increases.

Thus, in one embodiment, when the skier enters a turn, the thrust which he produces, directed toward the sole of the ski, causes his boot to shift toward the inside of the ski. The inner edge is thus in a position closer to the bottom of the boot, which promotes the dynamic response of the ski. In addition, in another embodiment, this characteristic force may cause the platform to pivot relative to the upper face of the ski, resulting in the fact that the ski turns through a larger angle than the boot in order to obtain an oversteer effect making it possible to accentuate the holding of the turn.

In practice, the intermediate device advantageously comprises means for adjusting the activation threshold of the shifting means.

In other words, the intermediate device produces its effects only above a given impulse magnitude, and therefore a force which can be adjusted as a function, in particular, of the skier's weight.

According to a first basic mode of operation of the invention, the means capable of modifying the position of the mid-plane of the platform cause transverse translation thereof in the direction of the inner edge, under the effect of a compressive force directed toward the upper face of the ski. In other words, according to this first principle, the force for initiating the turn shifts the foot inward, in a displacement direction substantially perpendicular to the longitudinal plane of the ski. The axis of the boot remains parallel to the axis of the ski. The inner edge is moved slightly underneath the boot which, as desired, makes it possible to reduce the time for tilting from one edge to the other.

In a practical embodiment of this first operating principle, the means intended to cause transverse translation of the platform consist of at least one ramp inclined downward in the direction of the inner edge, in contact with at least one stop, which is also inclined, each located respectively on the platform and on the upper face of the ski.

In other words, the cam surfaces arranged opposite one another between the platform and the ski channel the force and convert a part of it into transverse displacement.

In practice, the stop may advantageously consist of an inclined ramp or a cylindrical roller whose axis of revolution is parallel to the longitudinal axis of the ski.

According to a second embodiment of this first operating principle, the means intended to allow transverse translation of the longitudinal plane of the platform consist of at least two connecting arms articulated, at their upper and lower ends respectively, under the platform and on one of the faces of the ski, about axes parallel to the longitudinal axis of the ski.

In other words, the platform is connected, for example, to the upper face of the ski by a number of arms which, under a vertical force, allow pivoting of the longitudinal axis of the platform relative to the longitudinal axis of the ski, by a deformable parallelogram effect.

In general, the return members consist of blocks of elastic material, or elastic leaf springs made of metal or other material, or alternatively coil springs.

According to a third embodiment of this first operating principle, the means intended to allow transverse translation of the longitudinal plane of the platform consist of at least one elastic leaf arranged between the platform and the upper surface of the ski, said leaf being oriented toward the lower face of the ski and toward the outer edge.

Thus, in this alternative embodiment, the platform is connected to the upper surface of the ski by at least one leaf oriented in such a way that depressing the platform leads to a deformation of the elastic leaf, causing transverse shifting of the platform.

In this way, the elastic leaf also returns the platform into its neutral position when the force ceases. In an advantageous variant, the elastic leaf may be embedded in an elastomer block which increases the return capacity of the intermediate device.

In a fifth embodiment of the first operating principle of the invention, the means capable of modifying the position of the mid-plane of the platform relative to the longitudinal plane of the ski consists of:

- a sloped wedge secured to the upper face of the ski, the slope of said wedge being oriented toward the inner edge;
- an elastic chock interposed between the sloped wedge and the platform.

In this variant, the vertical force exerted on the platform compresses and shears the elastic chock. The thickness difference of the elastic chock, due to the shape of the sloped wedge, causes this shearing and thereby the transverse shift.

In a second operating principle, the invention uses the bending of the ski, due to a thrust exerted by the skier, in order to modify the position of the inner edge. It is known that, in order to initiate a turn, it is necessary both to set the ski on the inner edge and exert an extra pressure. Under the effect of the dimension line of the ski, in particular the narrowness of the ski level with the support region, as well as the excess load, the board forming the ski bends downward. The fictitious line joining two fixed points located above the ski will thus become a chord which becomes shorter as the radius of curvature of the ski decreases. The invention therefore consists in using this movement of these fixed points toward one another and channels it using means advantageously distributed on the upper face of the ski and under the platform.

According to a first embodiment of this second operating principle, the means intended to allow transverse translation of the longitudinal plane of the platform consist of at least two guide grooves interacting with two pins, each arranged on the lower face of the platform and on the upper face of the ski, the directions of the grooves converging on the outer edge side of the ski.

In an advantageous form, the intermediate device also comprises at least one additional groove whose direction is parallel to the bisector of the directions of the guide grooves.

In this way, this complementary groove, whose direction is identical to that of the displacement of the platform, positively guides the transverse shift.

In a practical embodiment, the grooves are arranged on the platform and form through-slots. The angle of inclination of these guide grooves relative to the longitudinal plane of the platform is between 30° and 60°, and more favorably 45°.

In a second embodiment of this second operating principle, the means intended to allow transverse translation of the longitudinal plane of the platform consist of a set of at least two journals secured to the upper face of the ski, said journals accommodating cylindrical cams which can pivot eccentrically about the journals, said cams interacting with complementary cylindrical housings formed in the platform, so that moving the journals toward one another causes rotation of the cylindrical cams inside the housings and therefore lateral displacement of the platform.

In this way, as already mentioned, when a force is exerted, the bending of the ski causes the fixed points, in this case the journals, secured to the upper face of the ski, to move toward one another. The movement of these journals toward one another leads to rotation of the eccentric cams and thereby shifting of the platform.

According to a third basic operating principle of the invention, the intermediate device includes two platforms, respectively supporting the toe piece and the heel piece of the safety binding, so as to cause rotation of the longitudinal axis of the skier's foot, about an axis perpendicular to the upper face of the ski.

According to a first set of variants, the characteristic means of the invention are reversed from one platform to the other, while in another set, these means cause a displacement in the same sense but cause a shift whose amplitude differs from one platform to the other.

In other words, the invention according to this third operating principle causes the binding to pivot by a different shift, of identical or opposite sense, of the toe piece and of the heel piece.

In this way, during turning, the direction of the longitudinal axis of the foot is different from that of the longitudinal axis of the ski, in order to obtain an oversteer effect making it possible to accentuate the holding of the turn.

In a first embodiment of this third operating principle, the means intended to cause the platform to rotate consist of at least:

- a first ramp, inclined downward in the direction of the inner edge and in contact with at least a first stop, each located respectively on the first half-platform and on the upper face of the ski;
- a second ramp, inclined downward in the direction of the outer edge and in contact with at least a second stop, each located respectively on the second half-platform and on the upper face of the ski.

In other words, the intermediate device of this embodiment corresponds to two platforms already mentioned, combining opposing cam surfaces placed in a fashion which is reversed from one to the other.

In this way, when a force is exerted, the toe piece and the heel piece shift independently.

In an alternative embodiment, the inclinations of the first and second inclined ramps are different, which pivots the longitudinal axis of the boot relative to that of the ski.

In a second embodiment of the invention, operating on the principle of rotating the axis of the boot, the binding is mounted on two independent platforms equipped with articulated arms as already mentioned. In order to obtain the rotation by a shift which differs from one platform to the other, the arms corresponding to each platform are inclined in the opposite direction or have different arm inclinations.

Similarly, in a third embodiment of the invention, operating on the rotation principle, the two platforms are equipped with elastic leaves as already mentioned. In order to produce the rotation, in one variant, the leaves of the front platform are oriented toward the lower face of the ski and toward the outer edge, and the leaves of the rear platform are oriented toward the lower face of the ski and toward the inner edge, while in another variant, the inclinations of the leaves of the two platforms relative to the upper face of the ski are different.

In a similar variant, the means intended to allow transverse rotation of the longitudinal plane of the platform consist of a set of two journals secured to the upper face of the ski, the axis passing through the two journals not being parallel to the longitudinal plane of the ski, said journals accommodating cylindrical cams which can pivot eccentrically about the journals, said cams interacting with complementary cylindrical housings formed in the platform in a direction identical to that of the longitudinal axis of the ski, so that moving the journals toward one another causes rotation of the cylindrical cams inside the housings and displacement of the platform.

In this case, the movement of each journal toward one another generates a different angle of rotation on each cylindrical cam, and therefore pivoting of the platform relative to an axis perpendicular to the surface of the sole of the ski.

In general, the return member consists, in known fashion, of a compression spring, an elastic block or a leaf spring.

In addition, as regards the arrangement of the intermediate device relative to the ski, in some embodiments, the ski has a housing, level with the support region, inside which said intermediate device is at least partly fitted.

In order to contribute to facilitating independent mounting and manufacture, it may also be advantageous if the means intended to allow displacement of the platform, which are secured to the upper face of the ski, are mounted on a lower plate, itself secured to the ski.

BRIEF DESCRIPTION OF THE FIGURES

The way in which the invention is embodied, and all the advantages which result therefrom, will emerge clearly from the following description of a number of embodiments, supported by the appended figures, in which.

EMBODIMENTS OF THE INVENTION

As already mentioned, the object of the invention is to equip a ski with an intermediate device making it possible to modify the position of the boot relative to the ski when forces are exerted for initiating a turn.

As already mentioned, this device may cause transverse translation of the boot relative to the ski, shifting the inner edge of the ski relative to the inner face of the boot, which improves the setting of turns. According to another principle, the intermediate device makes it possible to rotate the axis of the boot relative to the longitudinal axis of the ski, causing an oversteer effect in which the tip tends to rotate more than the foot in order to describe a tight turn.

First Operating Principle of the Invention

EXAMPLE 1

Figure 1:
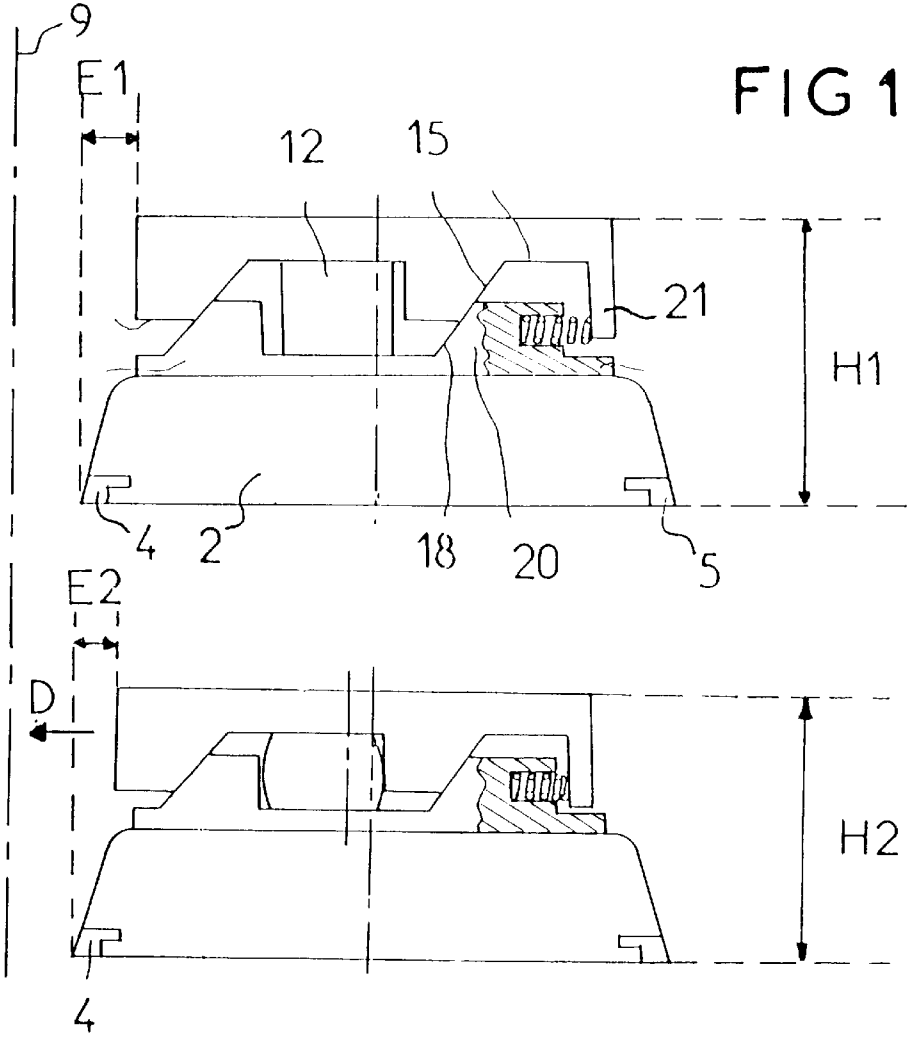
FIGS. 1 and 2 are cross-sectional views of an alternative embodiment of the invention, shown respectively in the neutral position and under the effect of a force exerted by the skier.

In the embodiment illustrated in FIG. 1, the pair of skis (1,2) is represented in section, the ski (1) being the left ski and the ski (2) being the right ski. The plane (9) is the plane of symmetry of the pair. This pair is symmetrically equipped with an intermediate device according to the invention.

This device is principally composed of three parts, namely a platform (10) on which the binding rests, a lower plate (11) secured directly to the upper face (3) of the ski, and an intermediate elastomer block (12) forming a return member.

On its lower face, the platform (10) has longitudinal bearing zones (13,14) of trapezoidal cross section. The inclined faces (15,16) of these trapezoidal bearing zones (13,14) are opposite the inclined faces (17,18) of the complementary bearing zones (19,20) of trapezoidal cross section, formed on the lower plate (11). The inclined slopes of these cam surfaces (15–18) are oriented downward and toward the inner edge (4) of the ski.

These opposing surfaces (15–18) may advantageously be covered with a layer intended to reduce the coefficient of friction, for example made of polytetrafluoroethylene.

In addition, this intermediate assembly comprises one or more return members, consisting either of an elastomer block (12) or of metal coil (22) or leaf springs. These return members are arranged between the platform (10) and the lower plate (11) either in the central region or in the lateral regions and bearing on a stop (21) formed for this purpose on one end of the platform (10).

Figure 2:
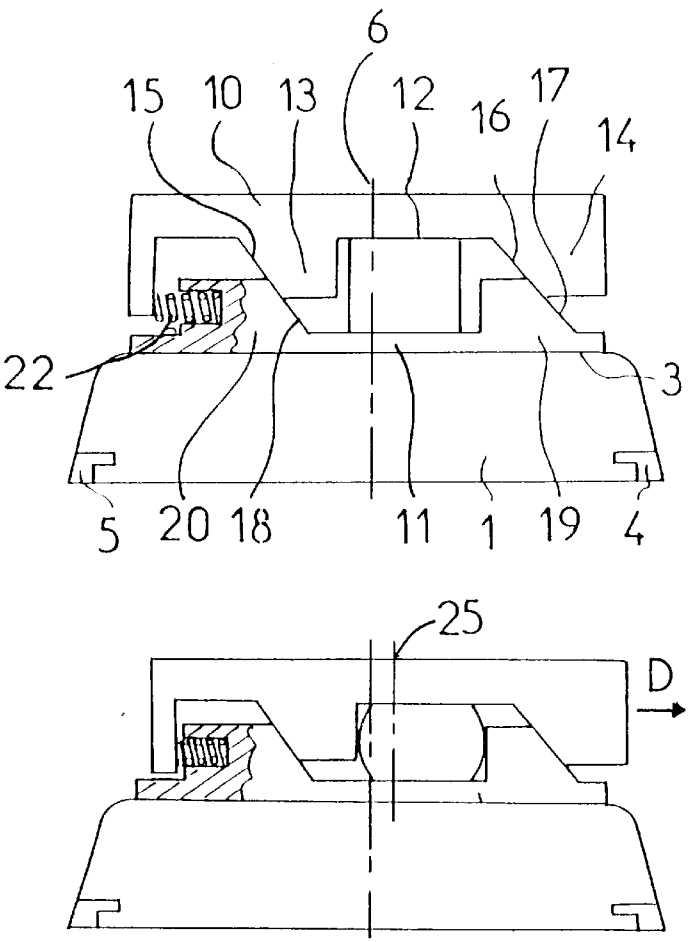

The way in which this embodiment operates can be understood easily on examining FIGS. 1 and 2.

Under the effect of a force (F) generated by the skier in the direction of the upper face (3) of the ski, the inclined slopes (15–18) of the trapezoidal cams slide on one another and cause lateral (E1–E2) and vertical (H1–H2) displacement of the platform (10) in the direction (D) of the inner edge (4).

Clearly, the value of the displacement is a function of the slope given to the cam surfaces (15–18), of the coefficient of friction between these surfaces, and of the stiffness of the return device (12, 22).

As already mentioned, these parameters may advantageously be adjusted in order to ensure optimum displacement.

Typically, the position of the platform is considered not to vary solely under the effect of the skier's weight, also referred to as normal load, and it is observed that the results relating to control of the ski are greatly improved if, under the effect of a force corresponding to five to six times the skier's weight, the platform shifts laterally by one or two millimeters.

Of course, increasing the number of opposing cam surfaces, or giving them advantageous profiles making it possible for the shift to be progressive as a function of the force, would not depart from the scope of the invention.

Figure 3:
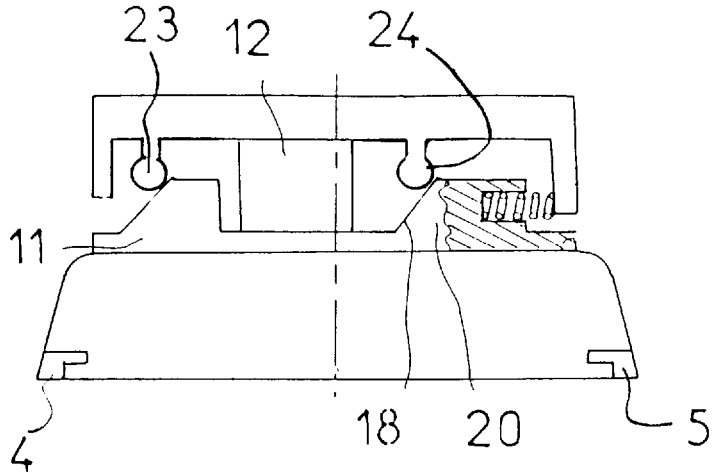
FIG. 3 is also a cross-sectional view, produced for a right ski of a variant of the embodiment illustrated in FIG. 1.

Thus, in the alternative embodiment shown in FIG. 3, the trapezoidal cam surfaces (15,16) of the platform (10) may be replaced by cylindrical rollers (23,24) which may optionally be made to rotate about their longitudinal axis, for example by means of rolling bearings.

Cessation of the force leads to activation of the return members (12–22) which return the platform to the initial position, in which its longitudinal plane (25) coincides with the longitudinal plane (6) of the ski.

Of course, integrating the lower plate inside the upper face of the ski, or replacing this lower plate by simple trapezoidal cams secured directly to the upper surface of the ski, would not depart from the scope of the invention.

EXAMPLE 2

Figure 4:
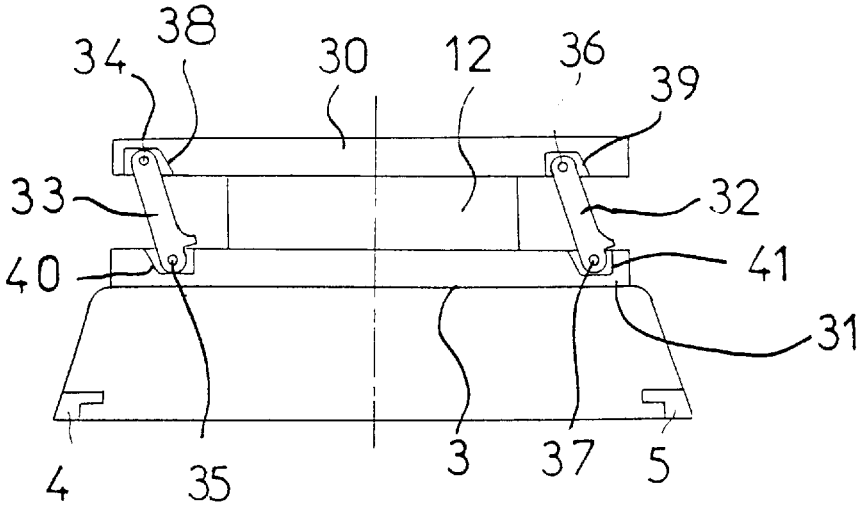
FIGS. 4 and 5 are cross sections of alternative embodiments operating with articulated arms, respectively in the neutral position and in the active position.
Figure 5:
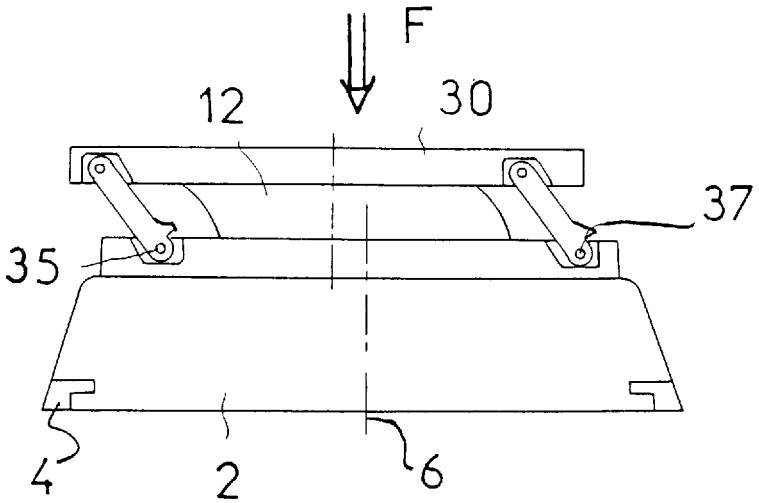

In a second variant, shown in FIGS. 4 and 5 which represent only a right ski, the platform (30) and the lower plate (31) secured to the upper face (3) of the ski are connected by articulated arms (32,33) inclined toward the inner edge (4) of the ski.

These arms (32,33) are articulated onto the platform (30) and onto the lower plate (31) by means of axes (34–37) parallel to the longitudinal axis of the ski. The inclined arms are articulated either inside housings (38–41) provided for this purpose on the platform (10) and on the lower plate (31), or by means of fork joints (not shown) arranged under the platform and on the lower plate.

Of course, the invention also encompasses the embodiments in which the lower plate (31) is replaced by simple fork joints, secured to the upper face of the ski, for articulating the arms (32,33).

As already mentioned, the space contained between the platform (30) and the lower plate (31) accommodates a return member (12) formed either by an elastomer block or by a mechanical spring (not shown).

During operation, this device behaves as follows. When the platform (30) is depressed by the impulse force F, the inclined arms (32,33) pivot about their articulation axle (34–37). In this way, the platform is displaced laterally in the direction of the initial inclination of the arms, that is to say toward the inner edge (4) of the ski.

EXAMPLE 3

Figure 6:
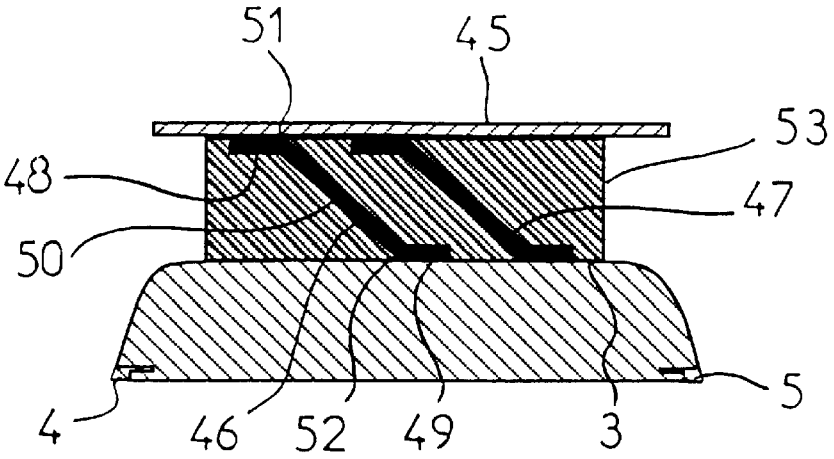
FIGS. 6 and 7 are cross sections of an embodiment operating with elastic leaves, respectively in the neutral position and in the active position.
Figure 7:
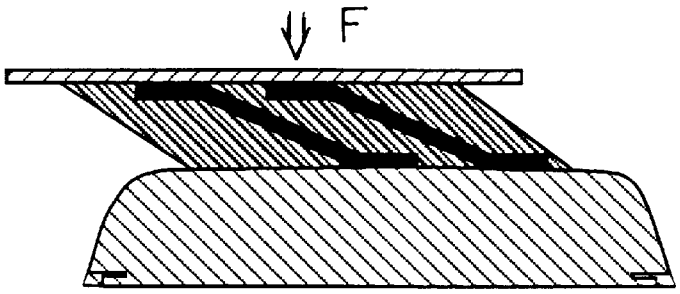

As shown in FIGS. 6 and 7, in a third alternative embodiment, the platform (45) is shifted relative to the upper face (3) of the ski by means of at least one elastic metal plate. In the form represented, these two metal plates (46,47) have two horizontal portions (48,49) respectively secured to the upper face (3) of the ski and to the lower face of the platform (45), and connected by an inclined portion (50). The inclination of the inclined portion (50) is directed downward and toward the outer edge (5) of the ski. The leaf may be made of spring steel or aluminum alloy.

Of course, similar results are obtained by using a larger number of leaves arranged in parallel.

In the advantageous form illustrated, the leaves (46,47) are embedded in an elastomer block (53) which reinforces the return effect of the leaf.

This intermediate device operates as follows.

When there is a force (F) exerted by the skier, the leaves deform at their fold regions (51, 52) and the inclined central part (50) acts as a lever arm which shifts the platform (51), as shown in the figure.

EXAMPLE 4

Figure 8:
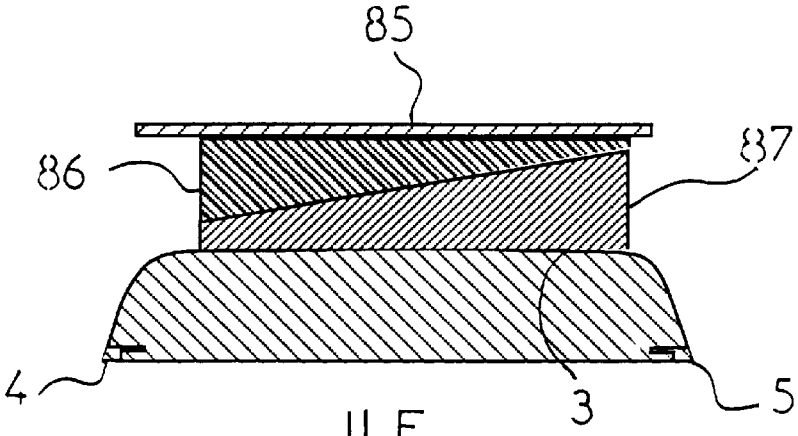
FIGS. 8 and 9 are cross sections of a device according to the invention, having a sloped wedge and elastic chock, respectively in the neutral position and in the active position.
Figure 9:
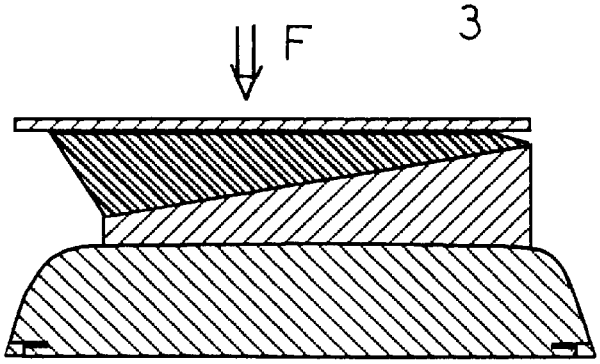

In the form illustrated in FIGS. 8 and 9, the platform (85) rests on an elastic chock (86) which itself rests on a sloped wedge (87) secured to the upper face (3) of the ski. The slope of this wedge is oriented downward and in the direction of the inner edge (4) of the ski.

Thus, under the effect of the depression caused by the skier's force (F), the elastic chock (86), typically made of elastomer, deforms and shears in such a way that the platform (85) is offset toward the inner edge of the ski, as illustrated in FIG. 9.

Second Operating Principle of the Invention

EXAMPLE 5

Figure 10:
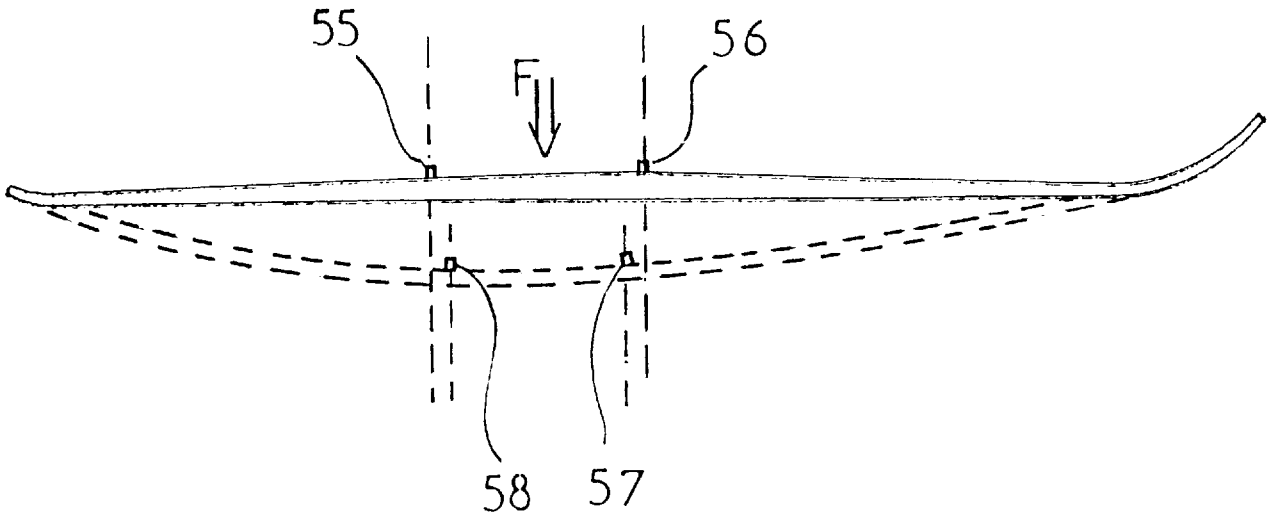
FIG. 10 is a side view of a ski, which shows a ski in the neutral position by a solid line and shows a ski undergoing bending due to an impulse force in dashed lines.
Figures 11, 12:
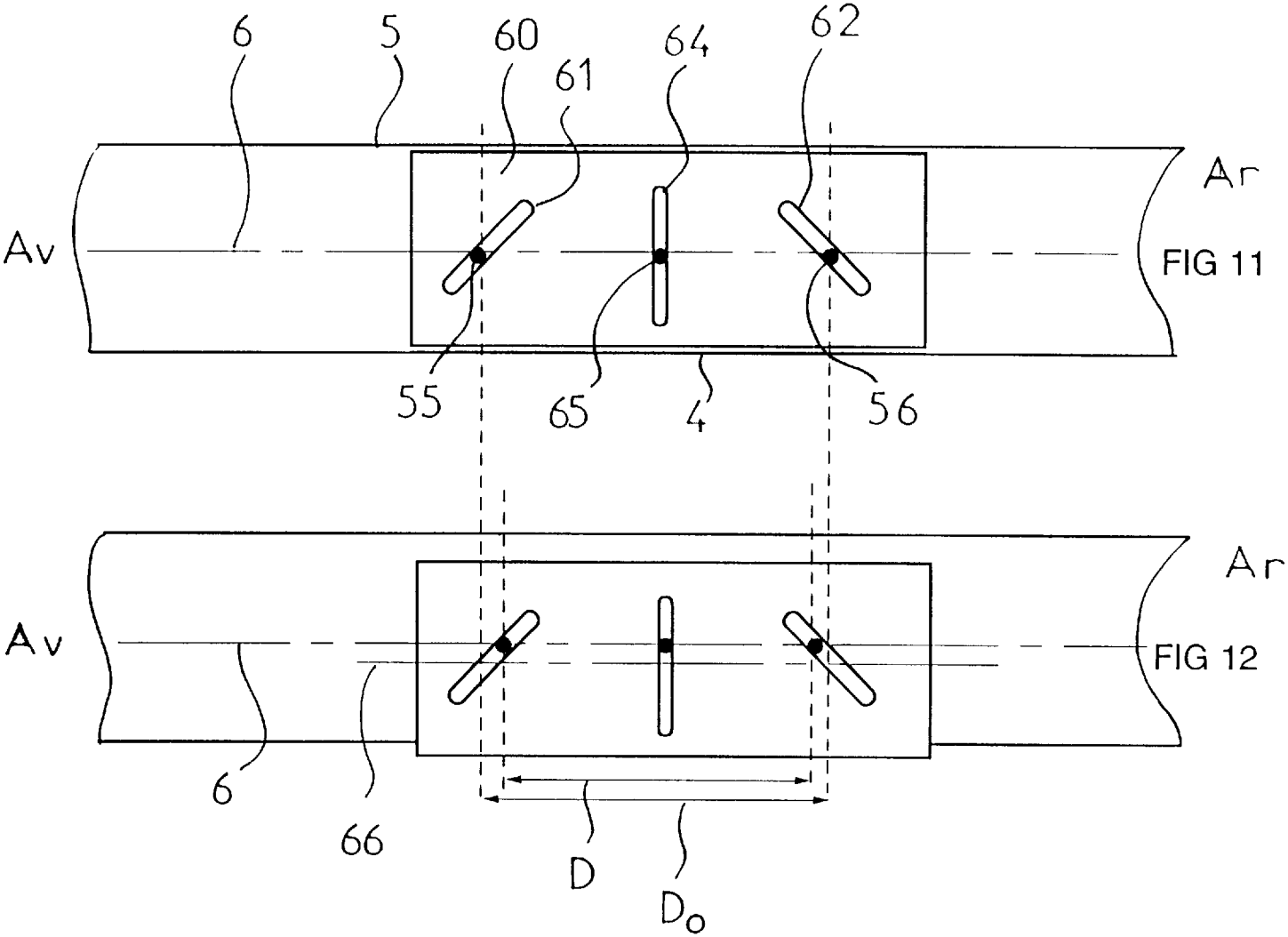
FIGS. 11 and 12 are plan views of a ski according to the invention, having a plate with a slot interacting with pins fixed on the ski, respectively in the neutral position and in the active position.

The embodiments shown in FIGS. 11 and 12 are based on the fact that, when there is a vertical force (F) exerted by the skier, the ski bends downward (see FIG. 10). The result of this is that, during the bending, two fixed points represented in the drawing by the references (55,56) tend to move toward one another (57,58).

In FIGS. 11 and 12, representing a portion of a right ski seen in plan, the front being located to the left in the drawing, the platform (60) according to this embodiment has at least two slots (61,62) arranged obliquely relative to the longitudinal plane (61) of the platform. These two slots (61,62) are spaced apart as far as possible in order to utilize the effect of distance between the fixed points secured to the ski. These slots (61,62) are oriented in such a way that they converge on the outer edge (5) side of the ski.

Two pins (55,56) secured to the upper surface (3) of the ski, either directly via fork joints or by means of a lower plate (not shown), are passed through these two oblique slots.

In addition, in an advantageous form, the platform (60) has a third slot (64) arranged transversely along a bisector of the oblique slots. This third slot also accommodates a pin (65) or a guide bar secured to the upper face (3) of the ski.

Preferably, the inclination of the slots (61, 62) relative to the longitudinal mid-plane (6) of the ski is between 30 and 60 degrees, and preferentially close to 45 degrees.

This device operates as follows.

When the ski bends, the fixed points represented by the pins (55, 56) tend to move toward one another. Of course, since the platform (60) is nondeformable in particular in view of the rigidity and the stiffness of the associated boot, the platform (60) tends to displace in order to adapt to the reduction in distance (Do–D) between the fixed points (55,56). In other words, moving the fixed points (55,56) toward one another tends to push the platform (60) toward the inner edge (4). This movement is, of course, facilitated and channelled by the complementary transverse guide groove (64). As expected, the longitudinal mid-plane (66) of the platform is shifted from that (6) of the ski toward the inner edge (4).

Of course, reversing the relative position of the pins and grooves would not depart from the scope of the invention, that is to say arranging the pins under the bottom of the platform and the grooves on a plate secured to the upper face of the ski. In the same spirit, although through-slots have been represented, it is obvious that the invention also encompasses the solutions in which the slots are replaced by closed grooves.

EXAMPLE 6

Figures 13, 14, 15:
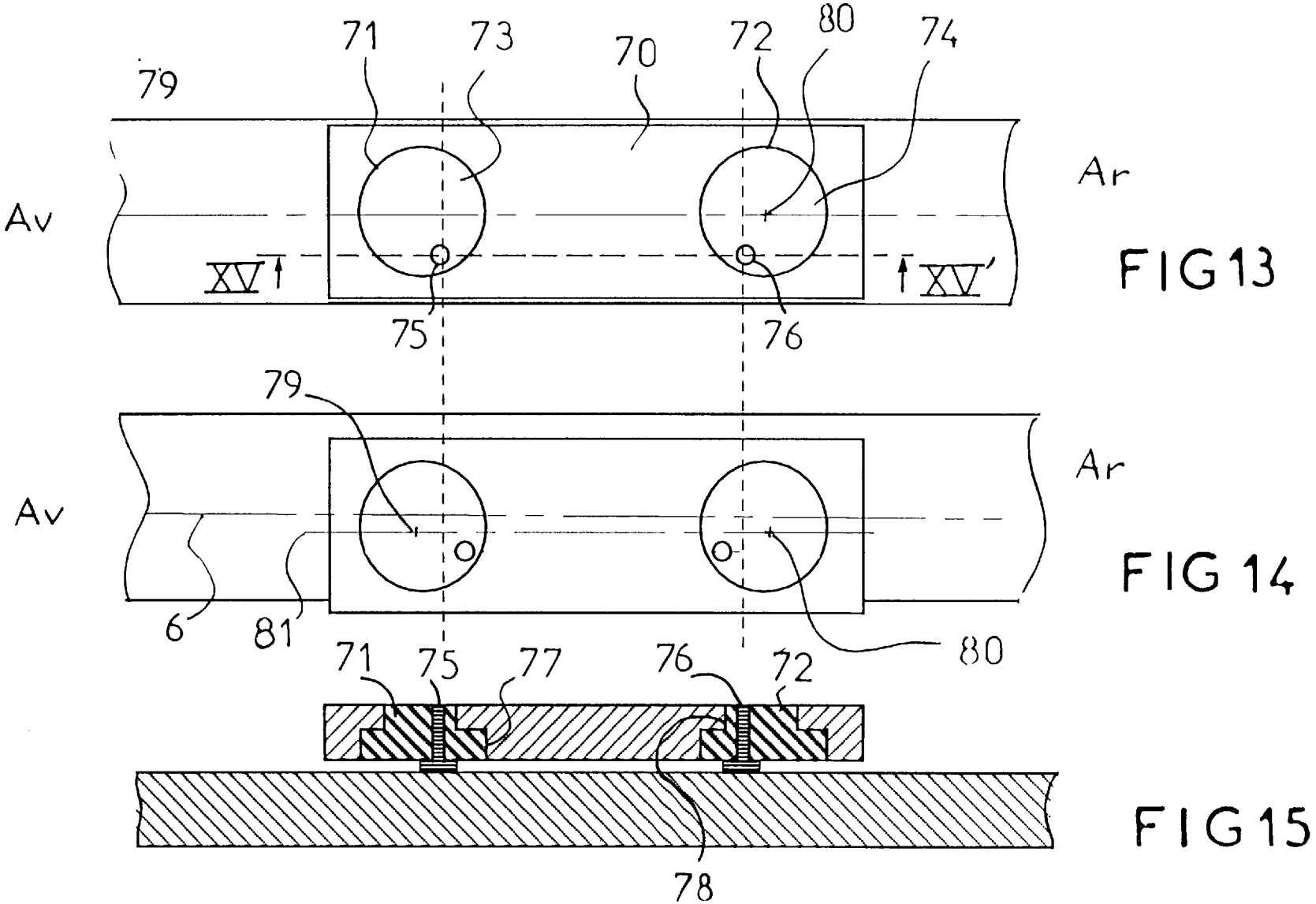
FIGS. 13 and 14 are plan views of a ski in which the device according to the invention operates by virtue of eccentric cams, respectively in the neutral position and in the active position.
FIG. 15 is a view in longitudinal section of the same device, along the axis XV—XV' in FIG. 13.
Figure 16:
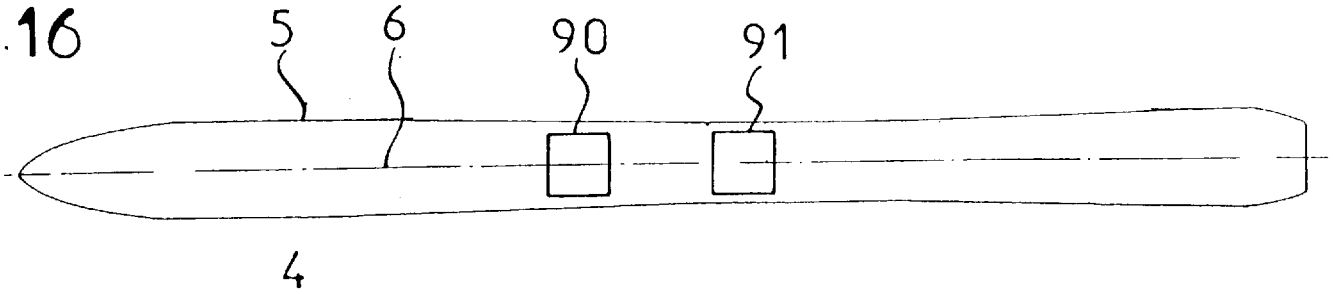
FIG. 16 is a schematic plan view of a ski having an intermediate device which is in two parts according to the invention which are respectively located under the heel piece and under the toe piece of the binding.

In the variant illustrated in FIGS. 13 to 15, the platform (70) has two circular through-openings (71,72) located in the extreme parts of the platform (70). These circular openings (71,72) accommodate two cylindrical cams (73, 74) which are free to rotate. Each of these cams (73,74) has a journal (75,76) arranged eccentrically and extending downward in the direction of the upper surface (3) of the ski to which they are secured. These cylindrical cams (73, 74) are mounted so as to pivot relative to the journals (75, 76).

In an advantageous form, the cylindrical cams (73,74) have two bearing zones (77,78) with different diameters which are fitted into two bearing zones, of complementary diameter, arranged in the platform level with each opening (71,72). The bearing zone (77) of greater diameter is arranged toward the lower face of the platform (70), the purpose of this being to hold this platform (70) using the cams (71) (see FIG. 14).

In order to improve the coefficient of friction between, on the one hand, the journals (75,76) and the cams (73,74) and, on the other hand, the cams (73,74) and the platform (70), the contact surfaces are treated and typically covered with polytetrafluoroethylene.

This device operates as follows. As already mentioned, when the ski bends as a result of a vertical force, the fixed points consisting of the journals (75, 76) secured to the upper face of the ski tend to move toward one another. This results, at the cams (73,74), in the latter rotating about the journals (75,76) in order to keep a constant distance between the centers (79,80) of each cam. These rotations cause the displacement of the platform (70) and, in particular, shifting of its mid-plane (81) relative to that (6) of the ski, as illustrated in FIG. 14.

Third Operating Principle of the Invention

The embodiment s described above make it possible to shift the longitudinal plane of the binding transversely relative to that of the ski. This is a translational movement which makes it possible to move the inner edge of the ski toward the inner edge of the boot. The variants described below, corresponding to a third operating principle of the invention, make it possible to modify the angle formed by the longitudinal mid-plane of the ski and that of the boot, under the effect of a force f or initiating turns.

In general, this operation can be obtained by using two platforms (90,91) as described above, the front platform (90) supporting the toe piece of the binding while the rear platform (91) accommodates the heel piece. Thus, each of the two platforms (90,91) is equipped with means allowing its longitudinal plane (92,93) to be shifted transversely relative to that (6) of the ski. The means may be identical or different in nature from one platform to the other. In other words, the invention encompasses the devices in which the front platform is, for example, shifted by a cam set, while the rear platform operates with compression and shearing of an elastic chock.

Figure 18:
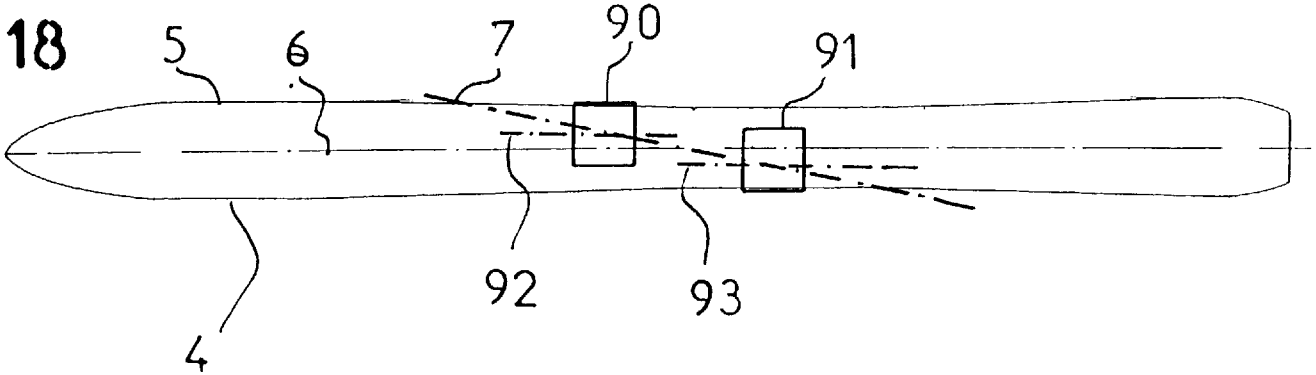

In addition, the rotational movement for orienting the boot may be obtained principally according to two different designs. Thus, in a first embodiment, illustrated in FIG. 18 for a right ski, the means allowing transverse shifting of each platform cause displacements in the opposite sense, that is to say the front platform (90) tends to be displaced in the direction of the outer edge (5), while the rear platform (91) is offset in the direction of the inner edge (4). In this way, the ski tends to turn through a greater angle than the boot, which is similar to an oversteer phenomenon.

Figure 17:
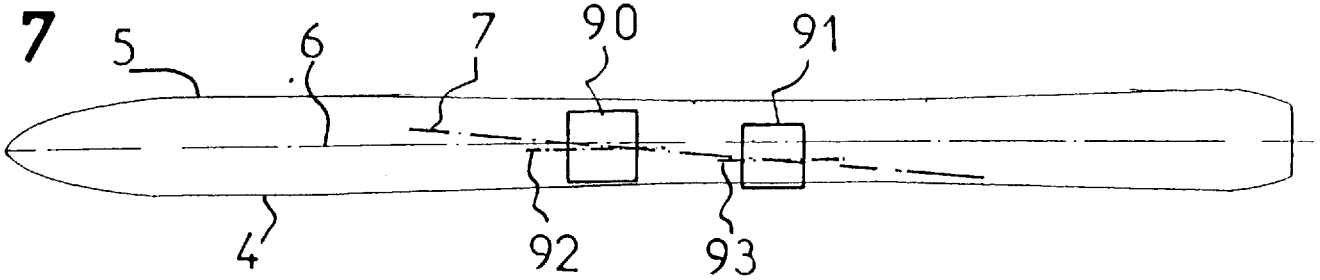
FIGS. 17 and 18 are two schematic sketches illustrating the different and independent displacements of the platforms according to the invention, and showing the rotation of the longitudinal axis of the boot relative to that of the ski.

In another embodiment, schematically illustrated in FIG. 17, the two platforms front (90) and rear (91) tend to be offset to the same side, that is to say toward the inner edge (4) but the shifting of the rear platform (91) is greater than that of the front platform (90), leading to the creation of an angle between the longitudinal plane of the boot (7) and that (6) of the ski.

EXAMPLE 7

Figures 19, 20:
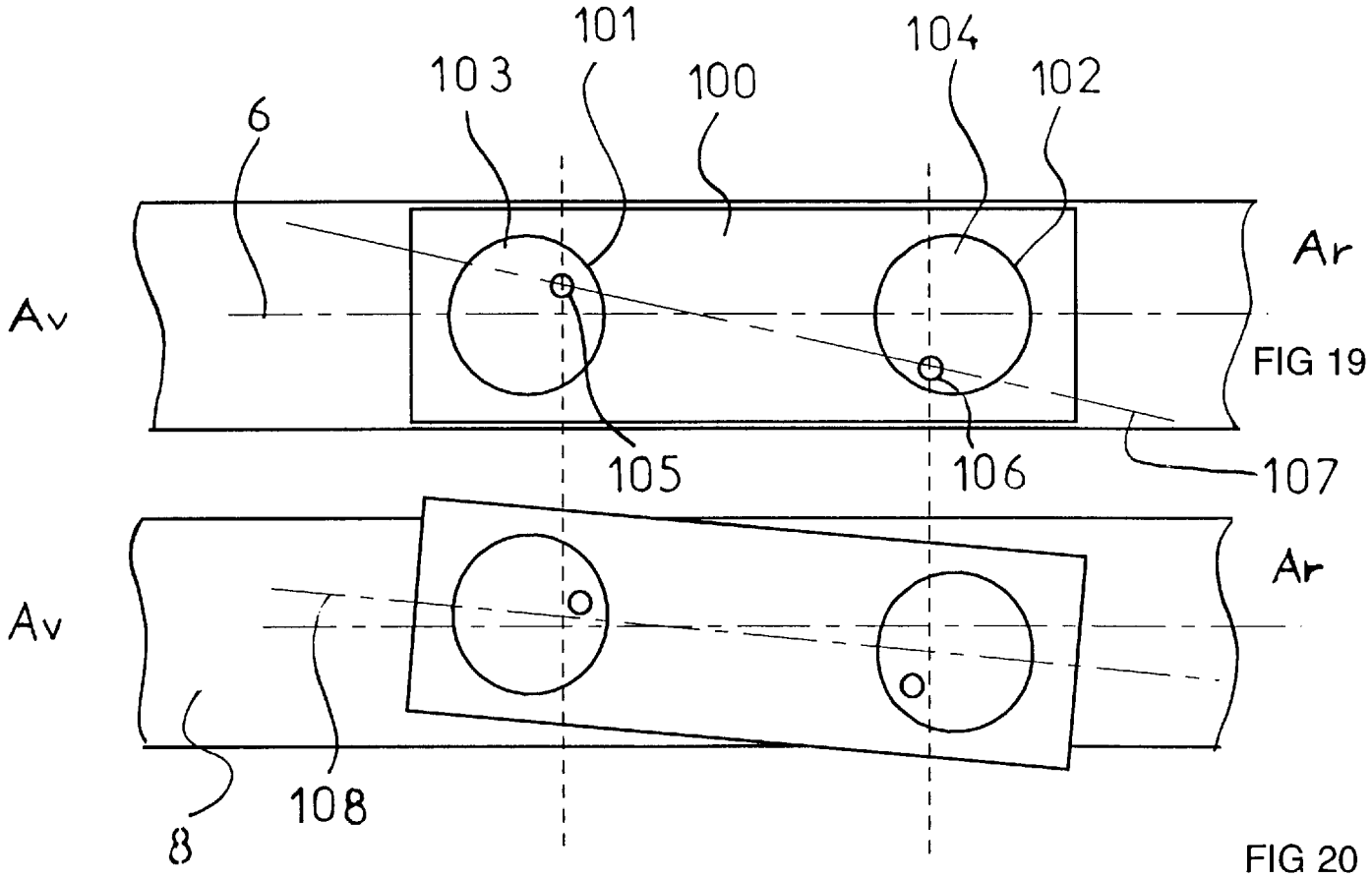
FIGS. 19 and 20 are two plan views of a ski equipped with a device according to the invention, respectively in the neutral position and in the active position in which the platform has pivoted relative to the ski.

The alternative embodiment illustrated in FIGS. 19 and 20 is derived from the embodiment corresponding to FIGS. 13 to 15. In this particular embodiment, the platform (100) accommodates, in two circular openings (101,102), two cylindrical cams (103,104) which each have an eccentric journal (105, 106) secured to the upper face (3) of the ski. In order to obtain pivoting of the longitudinal plane (107) of the platform (100), when the anchoring points of the journals (105,106) move toward one another as a result of the ski bending, these journals (105,106) are installed in such a way that the axis (107) joining them forms an angle with the longitudinal mid-plane (6) of the ski. In this way, when these anchoring points move toward one another, the platform (100) has a natural tendency to be positioned in the configuration illustrated in FIG. 20, in which the front (8) of the ski turns into the turn relative to the longitudinal plane (108) of the platform (100).

The above description shows that the ski according to the invention, that is to say one equipped with the characteristic device, makes it possible to shift the ski boot relative to the board when the skier exerts a vertical thrust, in particular when entering a turn. This shift may consist of a translation of the boot in a direction perpendicular to the longitudinal plane of the ski, or alternatively pivoting of the position of the boot relative to the ski.

The result of this is that the off-axis position of the inner edge makes it quicker to change from one edge to the other, this being particularly desirable when engaging in the sport of skiing.

In addition, pivoting leads to an oversteer phenomenon allowing the turn to be held more tightly.

I claim:

1. A piste ski, comprising:

a lower gliding face, bordered by ridges, respectively constituting an outer edge and an inner edge, said inner edge corresponding to one of two opposite edges when two skis of a pair of skis are laid flat beside one another;

an upper face for accommodating an intermediate device comprising a platform on which a safety binding, comprising a toe piece and a heel piece, is mounted, a longitudinal mid-plane of the platform being coincident with a longitudinal mid-plane of the ski, when the intermediate device supports a skier's weight, the intermediate device including means for shifting the position of the longitudinal mid-plane of the platform, relative to the longitudinal mid-plane of the ski;

and at least one return member for returning the two longitudinal mid-planes respectively of the platform and of the ski, to be coincident, wherein the shifting means will act, under the effect of a force directed perpendicularly to the upper face of the ski, causing a lateral shift of the longitudinal mid-plane of the platform, said lateral shift being an increasing function of said force.

2. The ski as claimed in claim 1, further comprising means for adjusting an activation threshold of the shifting means.

3. The ski as claimed in claim 1, wherein the means for shifting the position of the mid-plane of the platform will cause transverse translation in the direction of the inner edge, under the effect of a compressive force directed toward the upper face of the ski.

4. The ski as claimed in claim 3, wherein the transverse translation of the platform is effected by at least one ramp inclined downward in the direction of the inner edge, in contact with at least one stop each located respectively on the platform and on the upper face of the ski.

5. The ski as claimed in claim 4, wherein the stop comprises an inclined ramp.

6. The ski as claimed in claim 4, wherein the stop consists of a cylindrical roller (23,24) whose axis of revolution is parallel to the longitudinal axis of the ski.

7. The ski as claimed in claim 3, wherein the means intended to allow transverse translation of the longitudinal plane of the platform (30) consist of at least two connecting arms (32,33) articulated, at their upper and lower ends respectively, under the platform (30) and on one of the faces of the ski, about axles (34,37) parallel to the longitudinal axis of the ski.

8. The ski as claimed in claim 3, wherein the means intended to allow transverse translation of the longitudinal plane of the platform (45) consist of at least one elastic leaf (46,47) arranged between the platform (45) and the upper surface (3) of the ski, said leaf (46,47) being oriented toward the lower face of the ski and toward the outer edge (5).

9. The ski as claimed in claim 8, wherein the elastic leaf is embedded in an elastomer block (53).

10. The ski as claimed in claim 3, wherein the means intended to allow transverse translation of the longitudinal plane (66) of the platform (60) consist of at least two guide grooves (61,62) interacting with two pins (55,56), each arranged on the lower face of the platform (60) and on the upper face (3) of the ski, the directions of the grooves (61,62) converging on the outer edge (5) side of the ski.

11. The ski as claimed in claim 10, wherein the intermediate device also comprises at least one additional groove (64) whose direction is parallel to the bisector of the directions of the guide grooves (61,62).

12. The ski as claimed in claim 10, wherein the grooves (61,62) are arranged on the platform (60) and form through-slots.

13. The ski as claimed in claim 10, wherein the angle of inclination of the guide grooves (61,62) relative to the longitudinal plane (66) of the platform is between 30° and 60°, preferably close to 45°.

14. The ski as claimed in claim 1, wherein the means capable of modifying the position of the mid-plane of the platform relative to the longitudinal plane of the ski consist of:

a sloped wedge (87) secured to the upper face (3) of the ski, the slope of said wedge being oriented toward the inner edge (4);

an elastic chock (86) interposed between the sloped wedge (87) and the platform (85).

15. The ski as claimed in claim 3, wherein the means intended to allow transverse translation of the longitudinal plane (81) of the platform (70) consist of a set of at least two journals (75,76) secured to the upper face (3) of the ski, said journals (75,76) accommodating cylindrical cams (73,74) which can pivot eccentrically about the journals (75,76), said cams (73,74) interacting with complementary cylindrical housings (71,72) formed in the platform, so that moving the journals (75,76) toward one another causes rotation of the cylindrical cams (73,74) inside the housings (71,72) and lateral displacement of the platform (70).

16. The ski as claimed in claim 1, wherein the intermediate device includes two platforms (90,91), respectively supporting the toe piece and the heel piece of the safety binding.

17. The ski as claimed in claim 16, wherein the means making it possible to modify the position of the longitudinal plane (92,93) of each platform (90,91) are reversed from one platform to the other, so as to obtain a shift in the platforms on either side of the longitudinal mid-plane (6) of the ski and to cause the longitudinal axis (7) of the boot to rotate about an axis perpendicular to the upper face (3) of the ski.

18. The ski as claimed in claim 16, wherein the means making it possible to modify the longitudinal position (22, 23) of each platform (90,91) have the same sense and cause a shift whose amplitude differs from one platform to the other, so as to cause the longitudinal axis (7) of the boot to rotate about an axis perpendicular to the upper face of the ski.

19. The ski as claimed in claim 16, wherein the means intended to cause the platform to rotate consist of at least:

a first ramp, inclined downward in the direction of the inner edge and in contact with at least a first stop, each located respectively on the first half-platform and on the upper face of the ski;

a second ramp, inclined downward in the direction of the outer edge and in contact with at least a second stop, each located respectively on the second half-platform and on the upper face of the ski.

20. The ski as claimed in claim 17, wherein the inclinations of the first and second inclined ramps are different.

21. The ski as claimed in claim 7, wherein the arms corresponding to each half-platform are inclined in the opposite direction.

22. The ski as claimed in claim 7, wherein, in the neutral position, the inclinations of the arms of the half-platforms are different.

23. The ski as claimed in claim 8, wherein one of the leaves is oriented toward the lower face of the ski and toward the outer edge, and wherein the other leaf is oriented toward the lower face of the ski and toward the inner edge.

24. The ski as claimed in claim 8, wherein, in the neutral position, the inclinations of the two leaves relative to the upper surface of the ski are different.

25. The ski as claimed in claim 1, wherein the means intended to allow transverse rotation of the longitudinal plane (108) of the platform (100) consist of a set of two journals (105,106) secured to the upper face (3) of the ski, the axis (107) passing through the two journals (105,106) not being parallel to the longitudinal plane (6) of the ski, said journals (105,106) accommodating cylindrical cams (105, 106) which can pivot eccentrically about the journals (105, 106), said cams (103,104) interacting with complementary cylindrical housings (101,102) formed in the platform (100), so that moving the journals (105, 106) toward one another causes rotation of the cylindrical cams inside the housings and displacement of the platform.

26. The ski as claimed in claim 1, wherein the means intended to allow transverse rotation of the longitudinal plane of the platform consist of a set of two journals secured to the upper face of the ski, the axis passing through the two journals being parallel to the longitudinal plane of the ski, said journals accommodating cylindrical cams which can pivot eccentrically about the journals, said cams interacting with complementary cylindrical housings formed in the platform along an axis not parallel to the longitudinal plane of the platform, so that moving the journals toward one another causes rotation of the cylindrical cams inside the housings and displacement of the platform.

27. The ski as claimed in claim 1, which has a housing, level with the support region, inside which the intermediate device is at least partly fitted.

28. The ski as claimed in claim 1, wherein the means intended to allow displacement of the platform, which are secured to the upper face of the ski, are mounted on a lower plate, itself secured to the ski.

* * * * *